US010737296B2

(12) United States Patent
Heinz Stahlhöfer Bergmann

(10) Patent No.: US 10,737,296 B2
(45) Date of Patent: Aug. 11, 2020

(54) GRAIN-CLEANING MACHINE

(71) Applicant: TMSA—TECNOLOGIA EM MOVIMENTAÇÃO S.A., Porto Alegre (BR)

(72) Inventor: Ingo Heinz Stahlhöfer Bergmann, Canoas (BR)

(73) Assignee: TMSA—TECNOLOGIA EM MOVIMENTAÇÃO S.A., Porto Algere (BR)

( * ) Notice: Subject to any disclaimer, the term of this patent is extended or adjusted under 35 U.S.C. 154(b) by 0 days.

(21) Appl. No.: 16/088,185

(22) PCT Filed: Feb. 16, 2017

(86) PCT No.: PCT/BR2017/000015

§ 371 (c)(1),
(2) Date: Sep. 25, 2018

(87) PCT Pub. No.: WO2017/143417

PCT Pub. Date: Aug. 31, 2017

(65) Prior Publication Data

US 2019/0193117 A1 Jun. 27, 2019

(30) Foreign Application Priority Data

Feb. 26, 2016 (BR) ..... 10 2016 004243

(51) Int. Cl.
*B07B 1/28* (2006.01)
*B07B 1/34* (2006.01)
(Continued)

(52) U.S. Cl.
CPC ..... *B07B 1/343* (2013.01); *B07B 1/28* (2013.01); *B07B 13/075* (2013.01); *B07B 13/16* (2013.01); *B07B 2201/04* (2013.01)

(58) Field of Classification Search
CPC ..... B07B 1/28; B07B 1/343; B07B 1/4645; B07B 2201/04; B07B 13/075; B07B 13/16
(Continued)

(56) References Cited

U.S. PATENT DOCUMENTS 2,040,196 A * 5/1936 Berrisford ..... B07B 4/08 209/467
3,425,553 A * 2/1969 Slovic ..... B07B 1/286 209/315
(Continued)

FOREIGN PATENT DOCUMENTS

BR 7900142 U 3/2001
BR 0003172 A 5/2001
BR PI0603488 A 2/2008

OTHER PUBLICATIONS

International Search Report and Written Opinion for PCT/BR2017/000015, dated Apr. 28, 2017.

*Primary Examiner* — Joseph C Rodriguez
(74) *Attorney, Agent, or Firm* — Piloff Passino & Cosenza LLP; Sean A. Passino; Rachel K. Pilloff

(57) ABSTRACT

A grain-cleaning machine for obtaining grains has a desired size which is greater than a lower value and less than or equal to an upper value. The grain-cleaning machine comprises an arrangement of sieves. The arrangement of sieves comprises at least two main sieve levels positioned overlapping each other. Each main sieve level comprises a respective fine sieve followed by a respective grain sieve. At least one lower sieve level comprises a respective lower grain sieve. The at least one lower sieve level being positioned below the main sieve levels. Each fine sieve has a first mesh provided with openings having an opening size which is equal to said lower value, and each grain sieve and each lower grain sieve have a second mesh provided with open-
(Continued)

ings having an opening size which is equal to said upper value.

2 Claims, 9 Drawing Sheets

(51) Int. Cl.
*B07B 13/16* (2006.01)
*B07B 13/075* (2006.01)

(58) Field of Classification Search
USPC ..... 209/241, 242, 255, 256, 257, 262–264, 209/311, 315–317
See application file for complete search history.

(56) References Cited

U.S. PATENT DOCUMENTS 4,234,416 A * 11/1980 Lower ..... B07B 13/16 209/247
4,322,288 A * 3/1982 Schmidt ..... B02B 1/02 209/240
4,576,713 A * 3/1986 Melin ..... B07B 1/46 137/561 A
4,652,362 A 3/1987 Mueller
4,806,235 A * 2/1989 Mueller ..... B07B 1/46 209/321
5,100,539 A * 3/1992 Tsutsumi ..... B07B 1/46 209/240
5,614,094 A * 3/1997 Deister ..... B01D 33/015 210/388
5,749,471 A * 5/1998 Andersson ..... B07B 1/46 209/314
7,665,614 B2 * 2/2010 Malmberg ..... B07B 1/46 209/264
8,061,523 B2 * 11/2011 Uebayashi ..... B07B 1/34 209/20
9,752,399 B2 * 9/2017 Timmerman ..... E21B 21/063
2009/0308819 A1 * 12/2009 Bailey ..... B01D 33/0338 210/780

* cited by examiner

GRAIN-CLEANING MACHINE

TECHNICAL FIELD

The present invention relates to a machine for cleaning grains, in particular grains from agriculture, by granulometric separation using sieves and a vibration system, for the processing of grains at a post-harvest stage.

STATE OF THE ART

A grain-cleaning machine, in particular grains from agriculture, is responsible for processing a mixture of grains and residues, separating the grains from the residues, such as stones, dust, straw, among other agricultural crop residues.

Particularly, the invention relates to a grain-cleaning machine which uses granulometric separation by sieves. In this case, the mixture of grains and residues is processed and separated into residues smaller than the grains, residues larger than the grains and clean grains.

A grain-cleaning machine of this type comprises a housing having an inlet opening for ingress of the mixture of grains and residues, a sieve arrangement disposed internally of the housing, and a vibration system configured to oscillate the sieve arrangement.

A conventional arrangement of sieves comprises at least two main sieve levels, positioned overlapping each other and inclined to the horizontal from a high side to a low side. Each level of main sieve comprises a respective grain sieve having a mesh configured to allow traversal of grains along with residues smaller than the grains. Below each grain sieve is arranged a respective grain-carrying channel in communication with at least one lower sieve level.

The lower sieve level is positioned below the respective main sieve levels and inclined to the horizontal from a high side to a low side, such that the high side of the lower sieve level is aligned to the low side of the main sieve levels and the low side of the lower sieve level is aligned to the high side of the main sieve levels. The lower sieve level comprises a fine sieve having a mesh configured to allow traversal of residues smaller than grains. Below the fine sieve is arranged a fine-carrying channel in communication with at least one outlet of residues smaller than the grains.

The low side of the lower sieve level is in communication with at least one grain outlet. The low side of each main sieve level is in communication with at least one outlet of residues larger than the grains.

In operation, the mixture of grains and residues enters the machine through the inlet opening and accesses the high side of each main sieve level, forming a layer of mixture on the respective grain sieves. Due to the inclination of each main sieve level and due to the oscillating movement of the sieve arrangement produced by the vibration system, each mixing layer moves toward the low side of the respective main sieve level. As the mixture progresses, the grains and residues smaller than the grains cross the grain sieve and fall onto the grain-carrying channel, and are then conveyed to the lower sieve level, and the residues larger than the grains proceed over the grain sieve until they reach the low side of each main sieve level, and are then conveyed to the outlet of residues larger than the grains.

Further, on each main sieve level there is arranged a respective curtain having an upper end fixed to a rod and a tail in contact with the grain sieve. The curtain is positioned transversely, so that about a quarter of the sieve area of each main sieve level is located behind the curtain, toward the low side. The curtain acts as a barrier for the grains with higher kinetic energy and/or bouncing grains, so that they are contained and accommodated on the grain sieve, so that they can pass through said grain sieve rather than being unduly discarded through the outlet of residues larger than the grains.

The grains and the residues smaller than the grains, which have passed through the grain sieve of each main sieve level, access the high side of the lower sieve level, forming a layer on the fine sieve. Due to the inclination of the lower sieve level and due to the oscillating movement of the sieve arrangement produced by the vibration system, the layer moves towards the low side of the lower sieve level. As the layer advances, the residues smaller than the grains cross the fine sieve and fall onto the fine-carrying channel, and then smaller residues are sent to the outlet of residues smaller than the grains, and the grains proceed over the fine sieve until they reach the low side of the lower sieve level, and are then conveyed to the grain outlet.

SUMMARY OF THE INVENTION

The invention aims to provide a grain-cleaning machine wherein the processing rate of the mixture of grains and residues is higher, for example expressed in tons per hour, compared to the processing rate of the prior-art machine, occupying an equivalent physical space.

According to the invention, the grain-cleaning machine has a sieve arrangement comprising at least two main sieve levels, positioned overlapping each other and with an inclination with respect to the horizontal from a high side to a low side, each main sieve level comprising a respective fine sieve followed by a respective grain sieve.

Beneath each fine sieve is disposed a respective fine-carrying channel in communication with at least one outlet of residues smaller than the grains, and below each grain sieve is arranged a respective grain-carrying channel in communication with at least one grain outlet.

The sieve arrangement further comprises at least one lower sieve level comprising a respective lower grain sieve, wherein below the lower grain sieve is disposed a lower grain-carrying channel in communication with at least one grain outlet. The respective lower sieve level is positioned below the respective main sieve levels, and inclined to the horizontal from a high side to a low side, the low side of each main sieve level is in communication with the high side of the respective lower sieve level through a vertical passage and the lower side of the lower sieve level is in communication with at least one outlet of residues larger than the grains.

Each fine sieve has a mesh configured to allow traversal of residues smaller than the grains, and each grain sieve has a mesh configured to allow traversal of grains.

In operation, the mixture of grains and residues enters the machine through an inlet opening and accesses the high side of each main sieve level, forming a mixture layer on the respective fine sieves. Due to the inclination of each main sieve level and due to the oscillating movement of the sieve arrangement produced by the vibration system, each mixture layer moves towards the low side of the respective main sieve level.

As the mixture progresses, the residues smaller than the grains cross the fine sieve and fall onto the fine-carrying channel, and are then directed to the outlet of residues smaller than the grains. The grains and residues larger than the grains proceed over the fine sieve and reach the grain sieve. The grains then pass through the grain sieve and fall onto the grain-carrying channel, and are then conveyed to the grain outlet. The residues larger than the grains, along with surplus grains that failed to cross the grain sieve, including the grains with higher kinetic energy and/or bouncing grains, proceed over the grain sieve until they reach the low side of each main sieve level, and are then conveyed through the vertical passage to the high side of the lower sieve level.

The surplus grains and the residues larger than the grains access the high side of the lower sieve level, forming a layer on the lower grain sieve. Due to the inclination of the lower sieve level, and due to the oscillating movement of the sieve arrangement produced by the vibration system, the layer moves towards the low side of the lower sieve level. As the layer progresses, the surplus grains cross the lower grain sieve and fall onto the lower grain-carrying channel, and are then conveyed to the grain outlet, and the residues larger than the grains proceed over the lower grain sieve until they reach the low side of the lower sieve level and are then sent to the outlet of residues larger than grains.

Advantageously, from the invention, the surplus grains, including the grains with higher kinetic energy and/or bouncing grains that failed to cross the grain sieve of the respective main sieve levels, have the possibility of being reprocessed at the lower sieve level. Therefore, there is no need for the presence of a curtain on each main sieve level. Thus, advantageously, the grain sieves of the main sieve levels began to work at full sieving capacity, while in the prior-art machine the sieve area of the grain sieve located behind the curtain, at each main sieve level, worked with a reduced sieving capacity. Accordingly, advantageously, the grain-cleaning machine of the invention is capable of achieving a higher processing rate of the mixture of grains and residues, for example, expressed in tons per hour, compared to the processing rate achieved by the prior-art machine, occupying an equivalent physical space.

BRIEF DESCRIPTION OF THE DRAWINGS

The invention will be better understood with the following detailed description, which will best be interpreted with the aid of the figures, namely.

DETAILED DESCRIPTION

Figure 1:
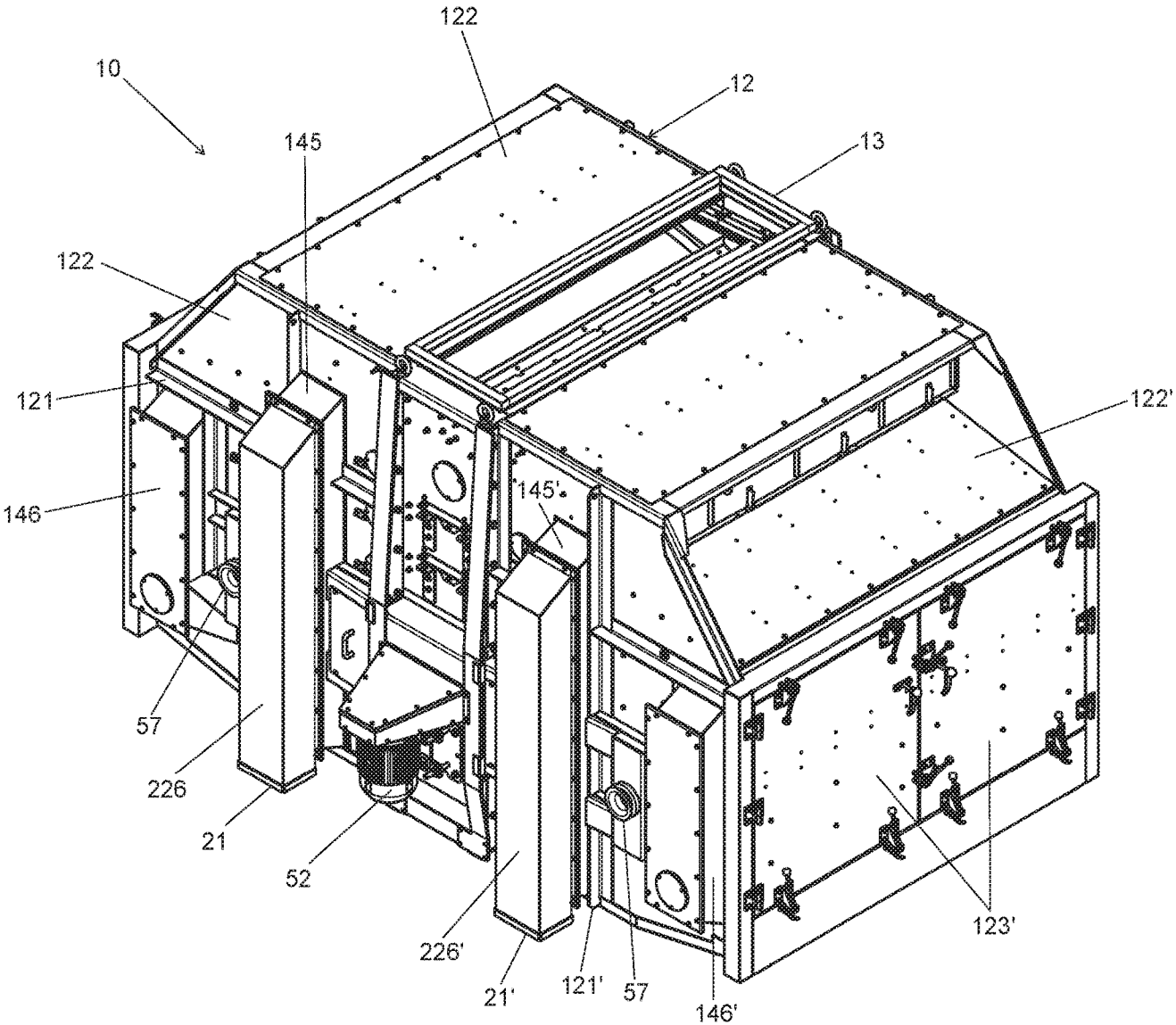
FIG. 1 shows a perspective view of a grain-cleaning machine.
Figure 2:
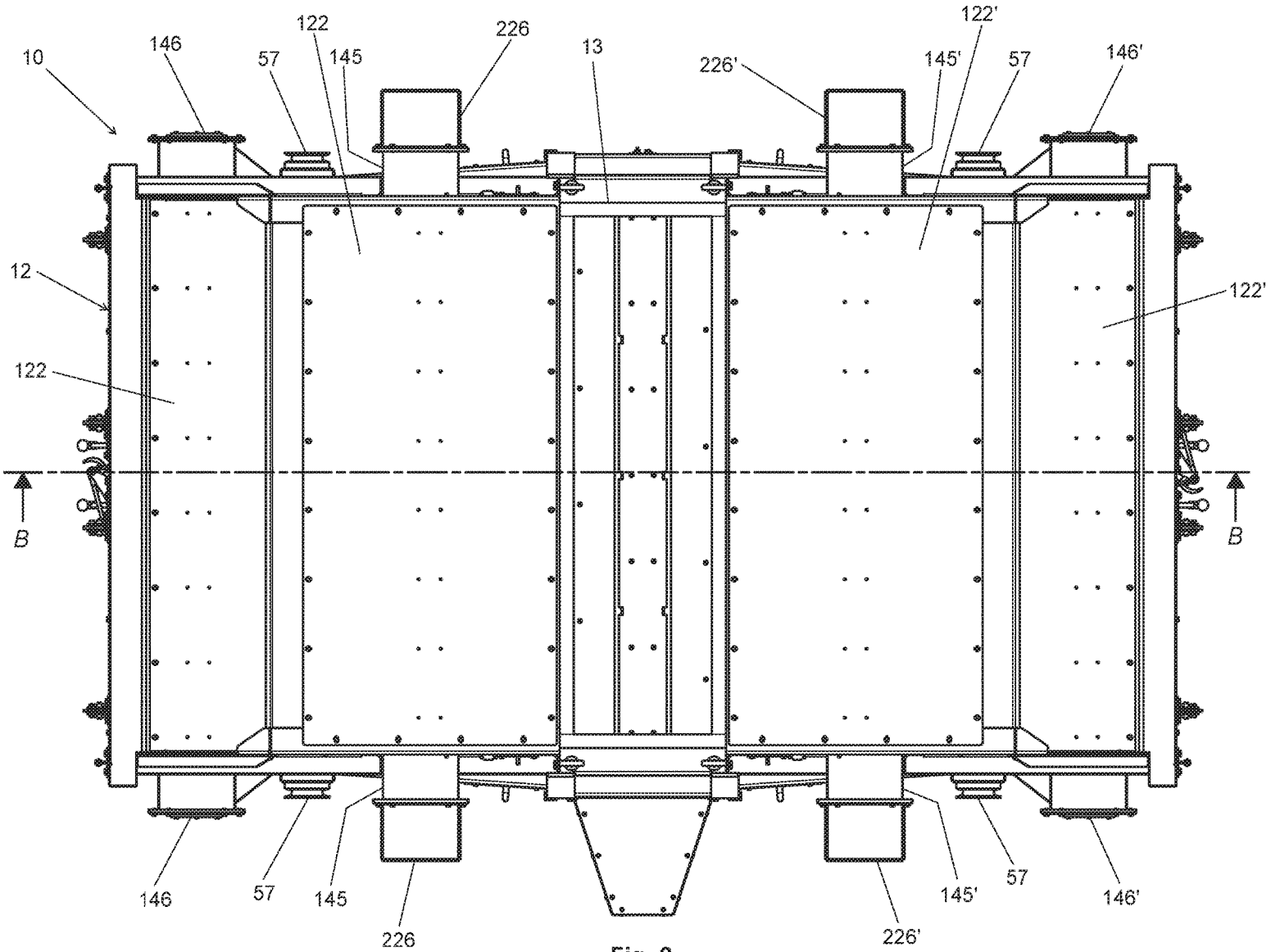
FIG. 2 shows a top view of the machine.

The invention proposes a grain-cleaning machine (10) comprising a housing (12) having an inlet opening (13). For example, the housing (12) may be formed by a frame (121) which receives closing plates (122), and may include ports (123') for maintenance, inspection, and cleaning of the machine (10), as desired.

The machine (10) further comprises a sieve arrangement disposed internally of the housing (12) and a vibration system configured to oscillate the sieve arrangement.

According to the invention, the sieve arrangement comprises at least two main sieve levels (14*a*, 14*b*, 14*c*) positioned overlapping each other and inclined to the horizontal from a high side (L1) to a low side (L2), each main sieve level (14*a*, 14*b*, 14*c*) comprising a respective fine sieve (141) followed by a respective grain sieve (142), wherein below each fine sieve (141) is arranged a respective fine-carrying channel (143) in communication with at least one outlet of residues smaller than grains (18) and below each grain sieve (142) is disposed a respective grain-carrying channel (144) in communication with at least one grain outlet (19).

The sieve arrangement further comprises at least one lower sieve level (16) comprising a respective lower grain sieve (162), wherein a lower grain-carrying channel (164) is disposed below the lower grain sieve (162) in communication with at least one grain outlet (19). The respective lower sieve level (16) is positioned below the respective main sieve levels (14*a*, 14*b*, 14*c*) and inclined to the horizontal from a high side (L3) to a low side (L4), the low side (L2) of each main sieve level (14*a*, 14*b*, 14*c*) is in communication with the high side (L3) of the respective lower sieve level (16) through a vertical passage (17) and the low side (L4) of the lower sieve level (16) is in communication with at least one outlet of residues larger than grains (20).

Further, each fine sieve (141) has a mesh configured to allow traversal of residues smaller than grains (R<) and each grain sieve (142, 162) has a mesh configured to allow traversal of grains (G, Ge).

Figure 3:
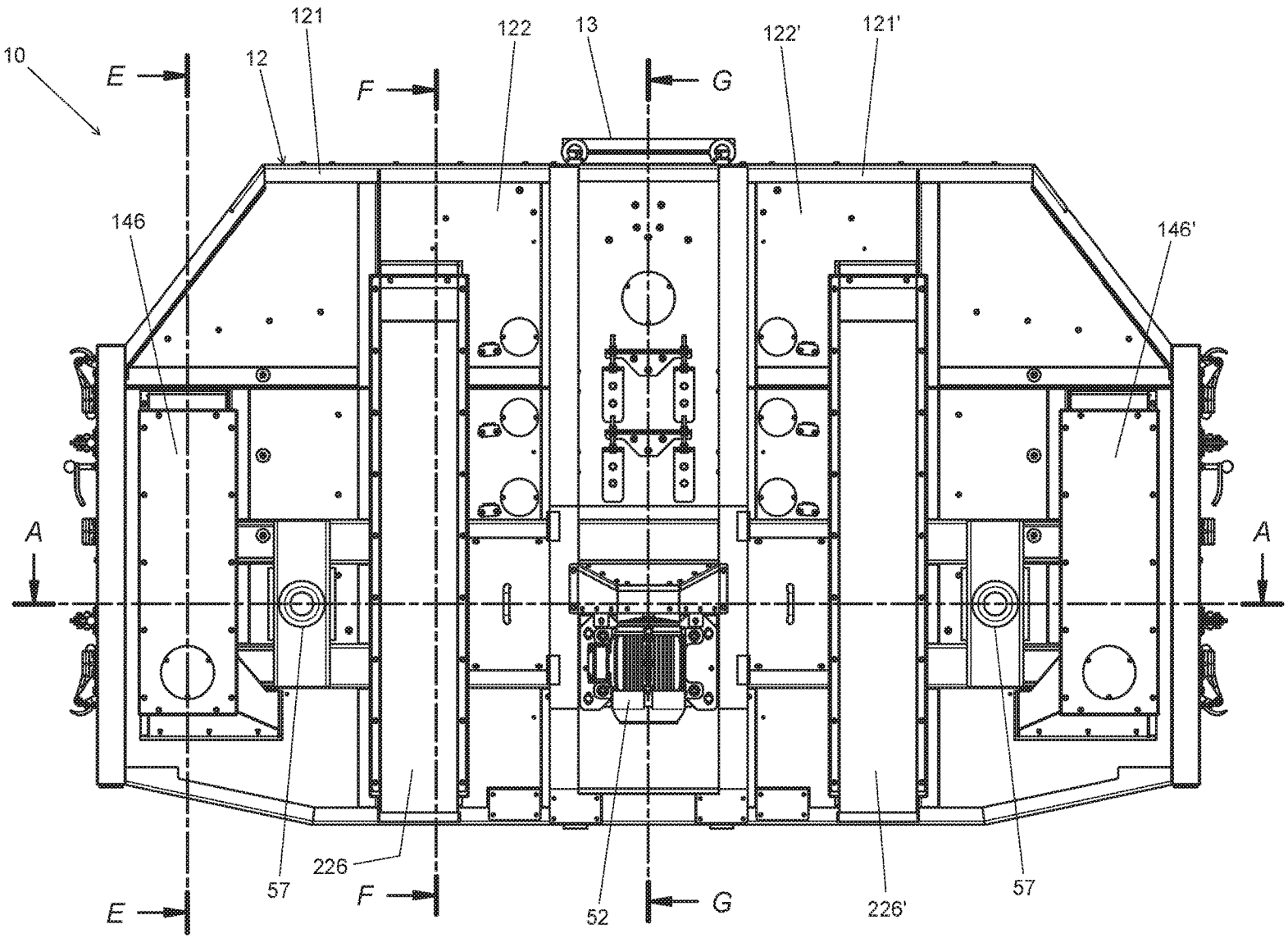
FIG. 3 shows a front view of the machine.
Figure 4:
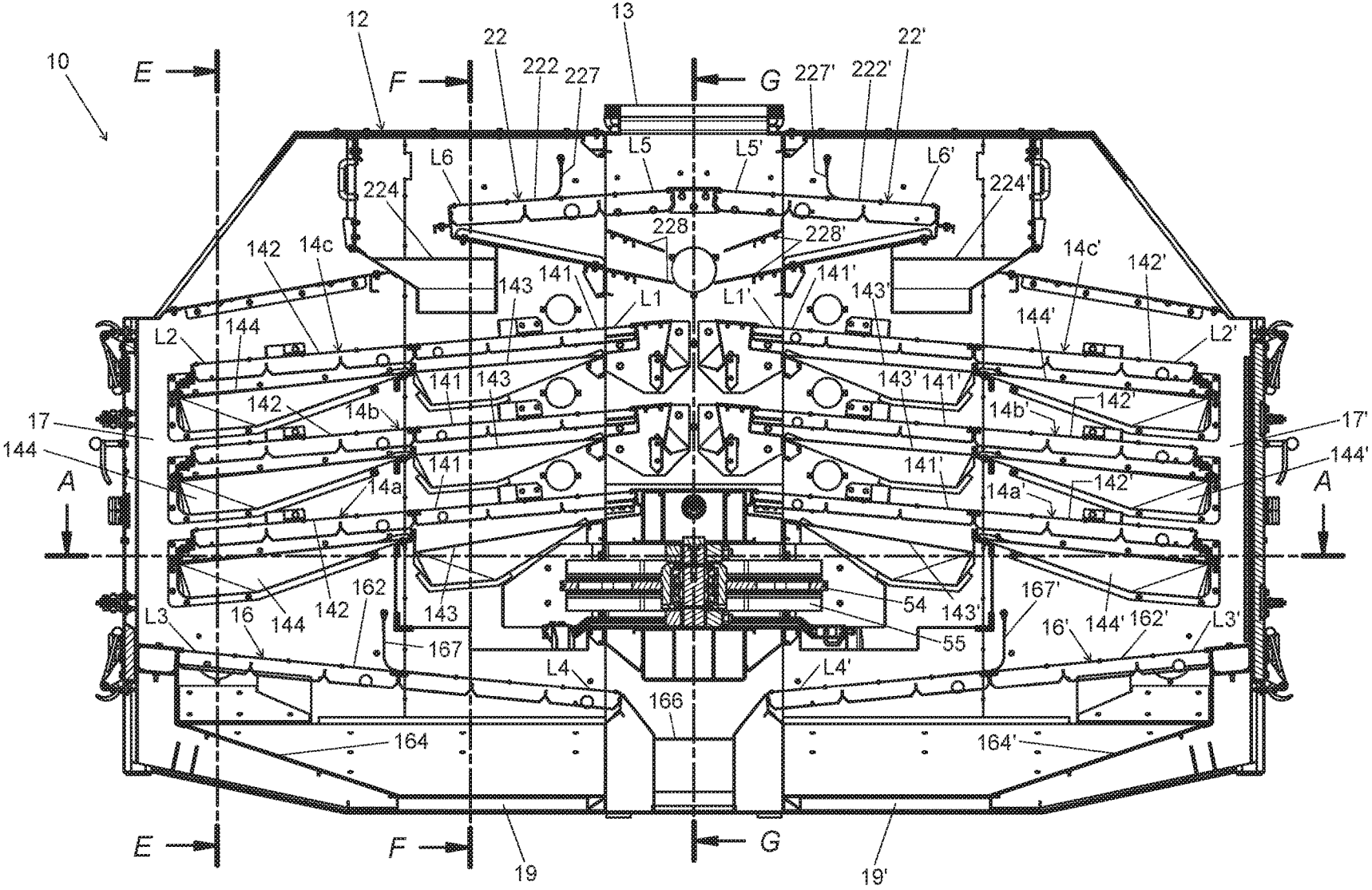
FIG. 4 shows a sectional view according to secant plane "B-B" shown in FIG. 2.
Figure 5:
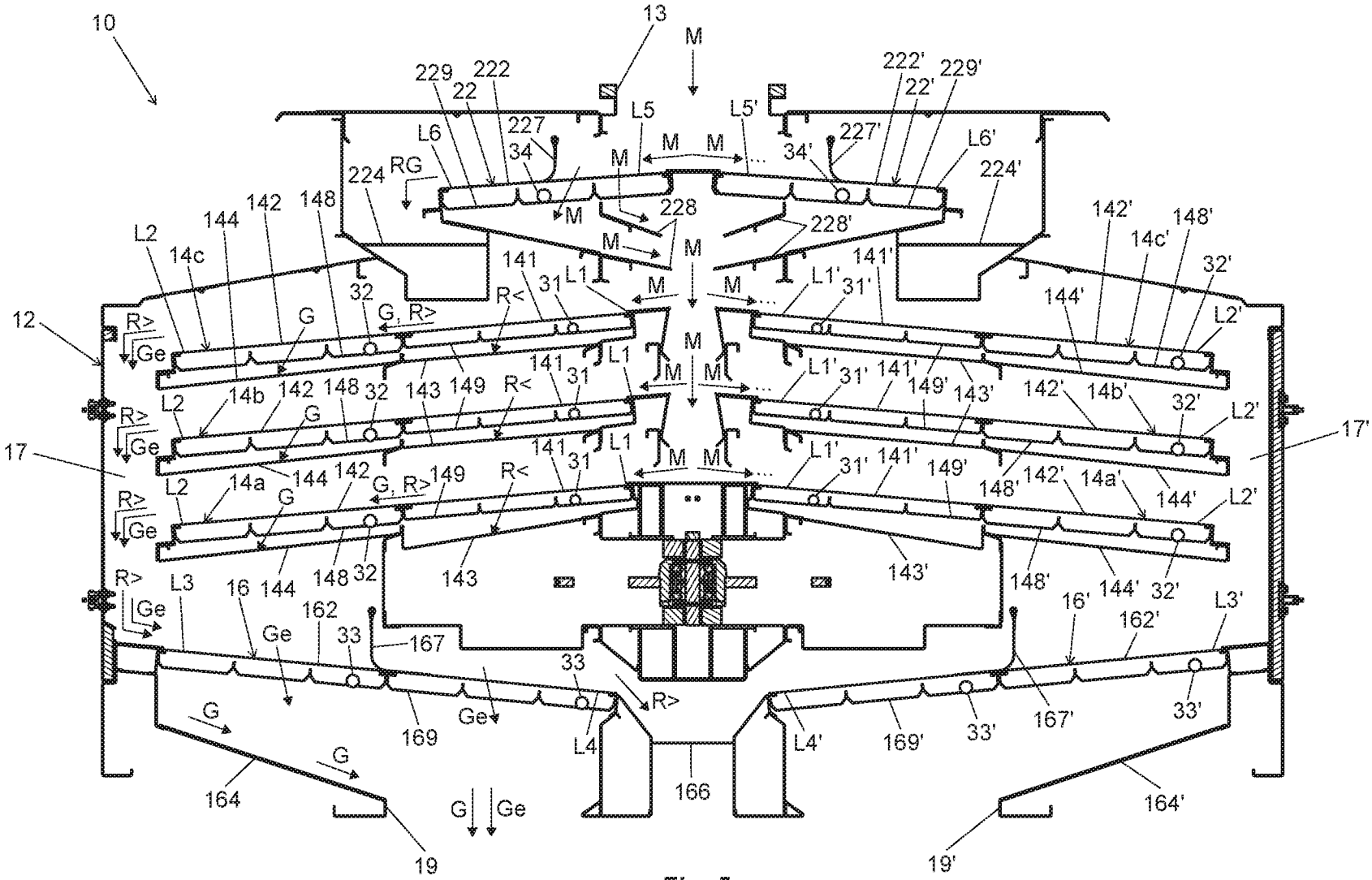
FIG. 5 shows a section cut according to secant plane "B-B" shown in FIG. 2.

In the embodiment shown, as best shown in FIGS. 4 to 6 and 8, the machine (10) comprises a first level of main sieve (14*a*), on which is disposed a second level of main sieve (14*b*), on which is arranged a third level of main sieve (14*c*). In the embodiment shown, as best shown in FIGS. 4 and 5, the machine (10) is symmetrically shaped along an axis of symmetry equivalent to the secant plane G-G shown in FIGS. 3 and 4. In this case, the components represented by a reference followed by a prime symbol (') corresponds to the respective symmetrical components represented by the same reference without the prime symbol (''). For example, the component represented by reference [14*a*'] corresponds to the first main sieve level symmetrical to the first main sieve level represented by reference [14*a*]. It should be understood that the machine (10) may be configured both symmetrically, as in the embodiment shown, and in a simple asymmetrical manner, which would be equivalent to a half machine in relation to the embodiment shown, including a vibration system suitable for each embodiment, as discussed below.

In operation, as can be seen from the schematic arrows shown in FIGS. 5, 6, 8, and 9, a mixture of grains and residues (M) enters the machine (10) through the inlet opening (13) and accesses the high side (L1) of each main sieve level (14*a*, 14*b*, 14*c*), forming a mixture layer (M) on the respective fine sieves (141). Due to the inclination of each main sieve level (14*a*, 14*b*, 14*c*) and due to the oscillating movement of the sieve arrangement produced by the vibration system, each mixture layer (M) moves towards the low side (L2) of the respective main sieve level (14*a*, 14*b*, 14*c*).

As the mixture (M) advances, the residues smaller than grains (R<) pass through the fine sieve (141) and fall onto the fine-carrying channel (143), and are then conveyed to the outlet of residues smaller than grains (18). According to the embodiment shown, as can best be seen in FIG. 6, each fine-carrying channel (143) is bifurcated in two paths, according to a downward slope starting from the center towards the front and back of the machine (10), each path being in communication with a respective outlet of residues smaller than grains (18), through a respective vertical conduit of fine (145).

Figure 8:
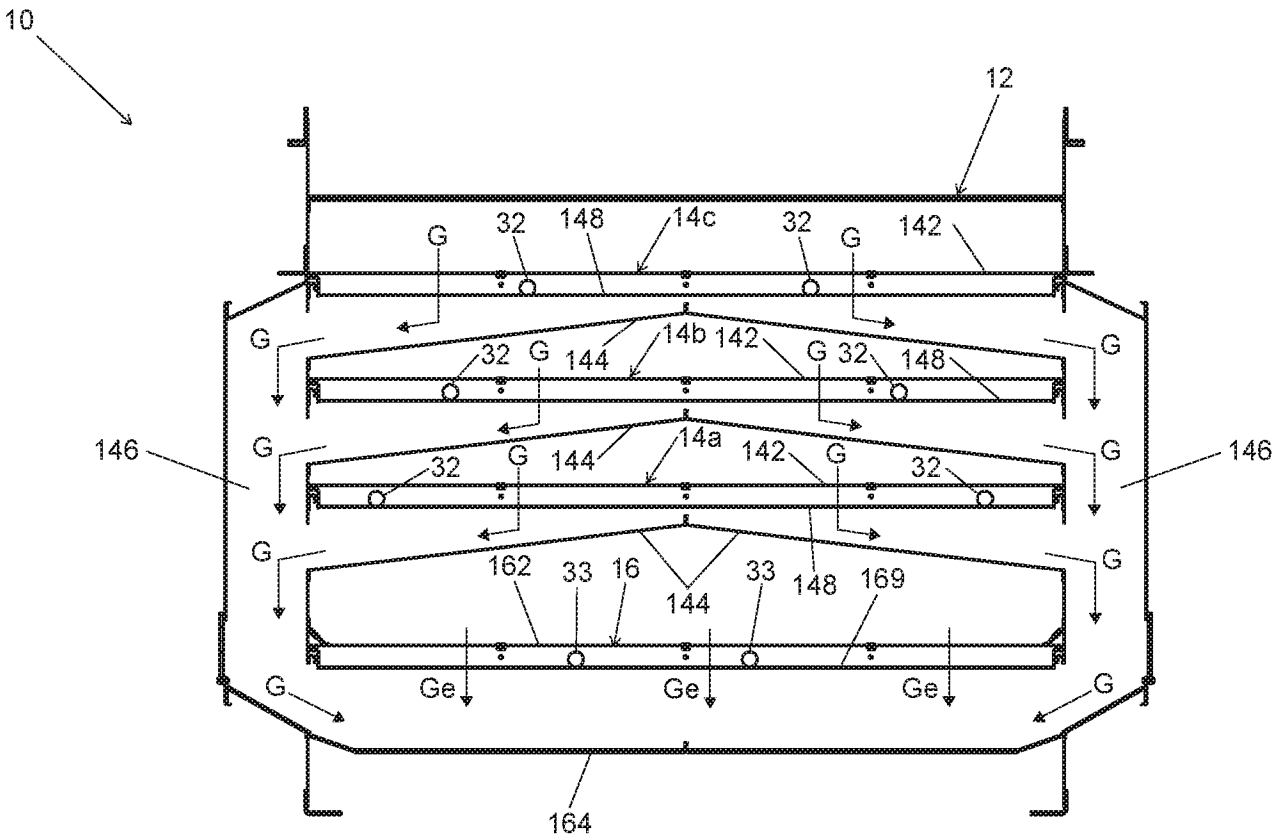
FIG. 8 shows a section cut according to the secant plane "E-E" shown in FIG. 3. For better understanding, the position of the secant plane "E-E" is also indicated in FIG. 4.
Figure 9:
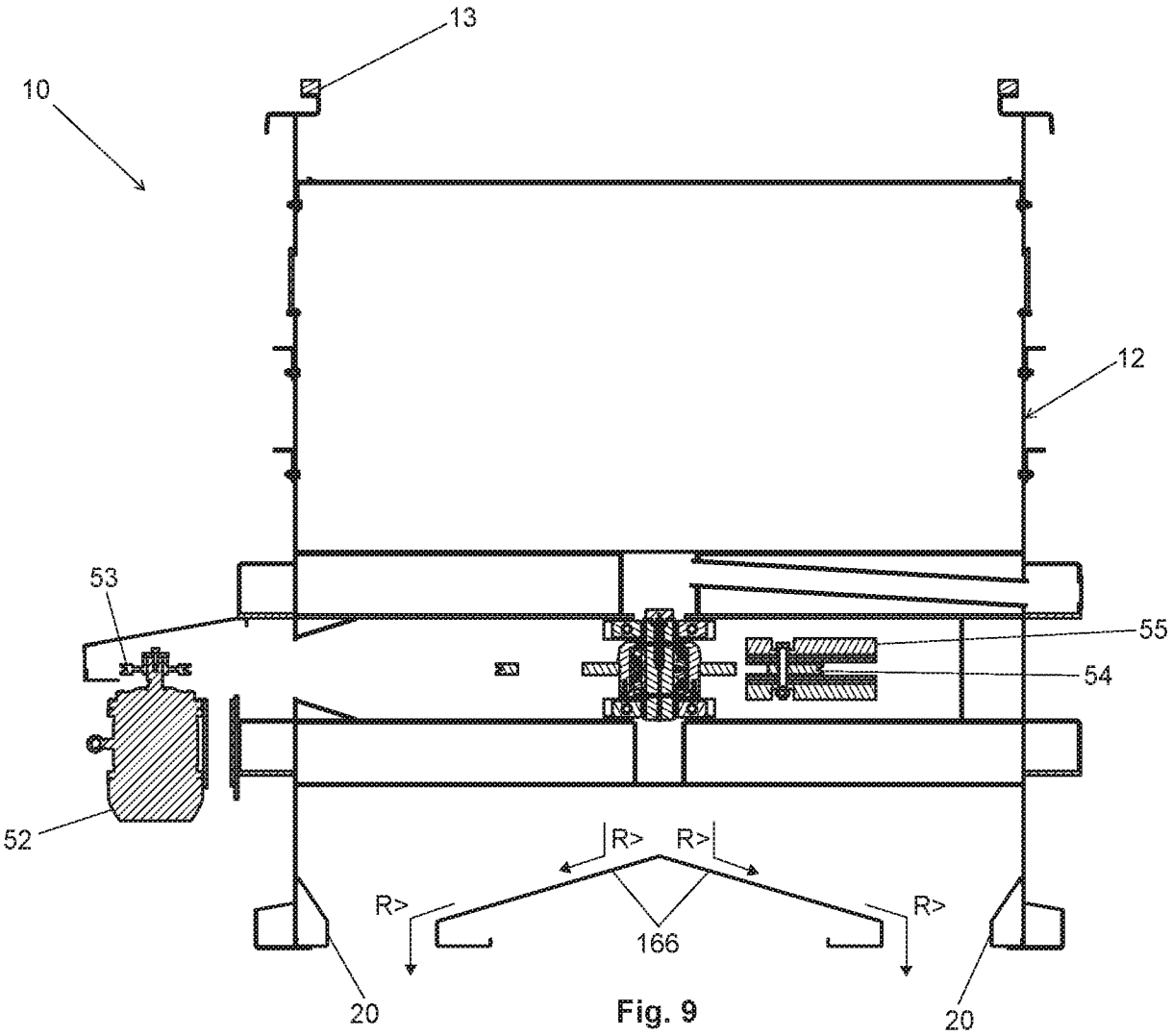
FIG. 9 shows a section cut according to the sectional plane "G-G" shown in FIG. 3. For better understanding, the position of the secant plane "G-G" is also indicated in FIG. 4.
Figure 10:
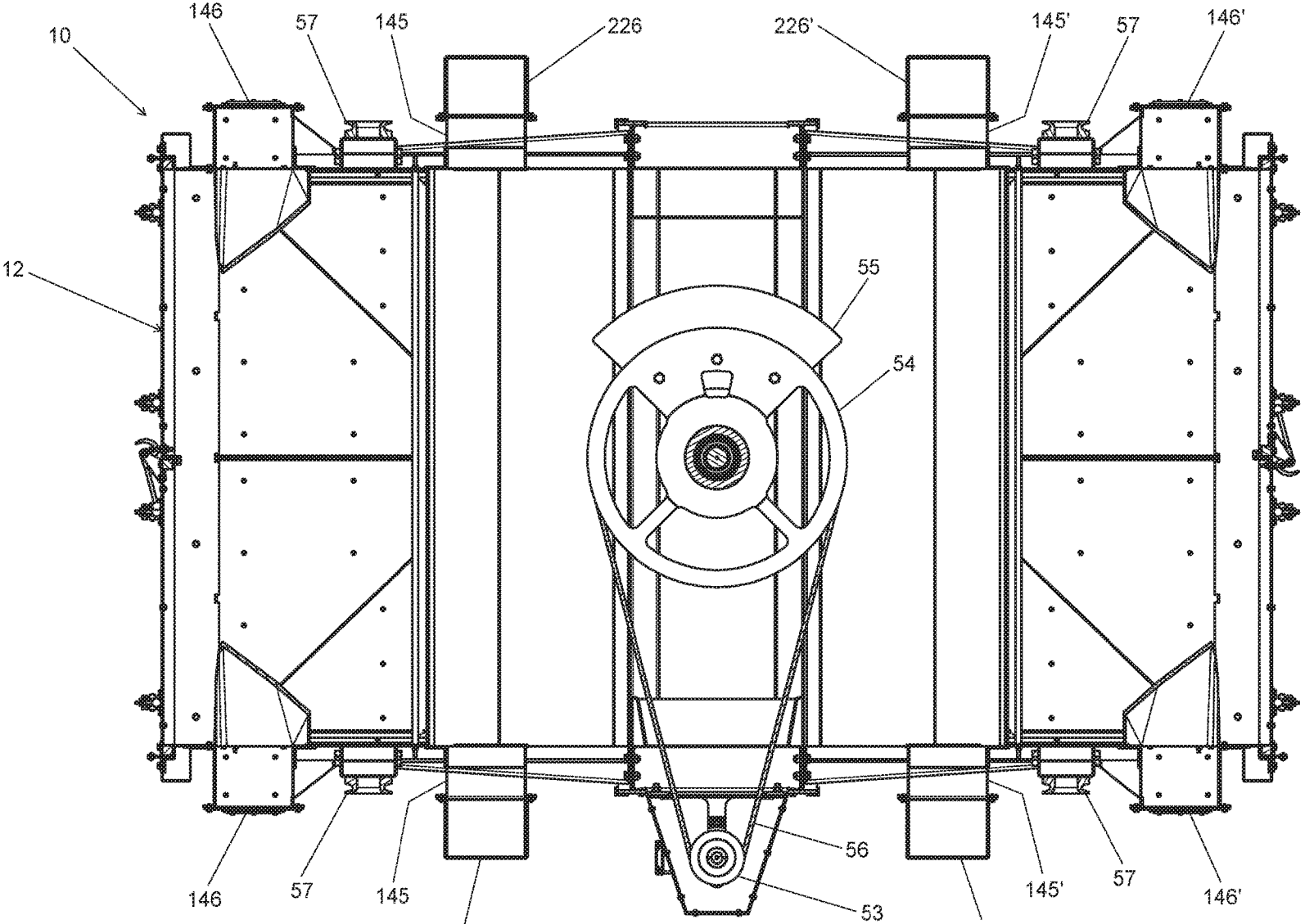
FIG. 10 shows a sectional view according to secant plane "A-A" shown in FIG. 3. For better understanding, the position of secant plane "A-A" is also indicated in FIG. 4.

The grains (G) and the residues larger than grains (R>) proceed to the fine sieve (141) and reach the grain sieve (142). The grains (G) then pass through the grain sieve (142) and fall onto the grain-carrying channel (144), and are then conveyed to the grain outlet (19). According to the embodiment shown, as best shown in FIG. 8, each grain-carrying channel (144) is bifurcated in two paths along a downward slope from the center towards the front and back of the machine (10), each path being in communication with the lower grain-carrying channel (164), through a respective vertical conduit of grains (146). The lower grain-carrying channel (164) has a slope toward the grain outlet (19). The grains (G) falling onto the grain-carrying channel (144) proceed from the respective vertical conduits of grains (146) to the lower grain-carrying channel (164), and are then conveyed to the grain outlet (19).

The residues larger than grains (R>), along with the surplus grains (Ge) that failed to cross the grain sieve (142), including the grains with higher kinetic energy and/or bouncing grains, proceed over the grain sieve (142) until they reach the low side (L2) of each main sieve level (14*a*, 14*b*, 14*c*), and then are conveyed through the vertical passage (17) to the high side (L3) of the lower sieve level (16).

The surplus grains (Ge) and the residues larger than grains (R>) access the upper side (L3) of the lower sieve level (16), forming a layer on the lower grain sieve (162). Due to the inclination of the lower sieve level (16) and due to the oscillating movement of the sieve arrangement produced by the vibration system, the layer moves toward the low side (L4) of the lower sieve level (16). As the layer progresses, the surplus grains (Ge) pass through the lower grain sieve (162) and fall onto the lower grain-carrying channel (164), and are then conveyed to the grain outlet (19) together with the grains (G) coming from the main sieve levels (14*a*, 14*b*, 14*c*).

The residues larger than grains (R>) proceed over the lower grain sieve (162) until they reach the low side (L4) of the lower sieve level (16), and are then sent to the outlet of residues larger than grains (20). According to the embodiment shown, as can best be seen in FIGS. 4, 5, and 9, the lower side (L4) of the lower sieve level (16) is in communication with a carrying channel of residues larger than grains (166), which is bifurcated in two paths along a downward slope from the center towards the front and back of the machine (10), each path giving access to a respective outlet of residues larger than grains (20), as can best be seen in FIG. 9.

Advantageously, from the invention, the surplus grains (Ge), including the grains with higher kinetic energy and/or bouncing grains, which failed to cross the grain sieve (142) of the respective main sieve levels (14*a*, 14*b*, 14*c*), have the possibility of being reprocessed at the lower sieve level (16). Thereby, there is no need for the presence of a curtain on each main sieve level (14*a*, 14*b*, 14*c*). Thus, advantageously, the grain sieves (142) of the main sieve levels (14*a*, 14*b*, 14*c*) started to work at full sieving capacity, whereas in the prior-art machine the sieving area of the grain sieve located after the curtain, at each main sieve level, worked with a reduced sieving capacity. Accordingly, advantageously, the grain-cleaning machine (10) of the invention is capable of achieving a higher processing rate of the mixture of grains and residues (M), for example expressed in tons per hour, compared to the processing rate achieved by the prior-art machine, occupying an equivalent physical space.

Figure 6:
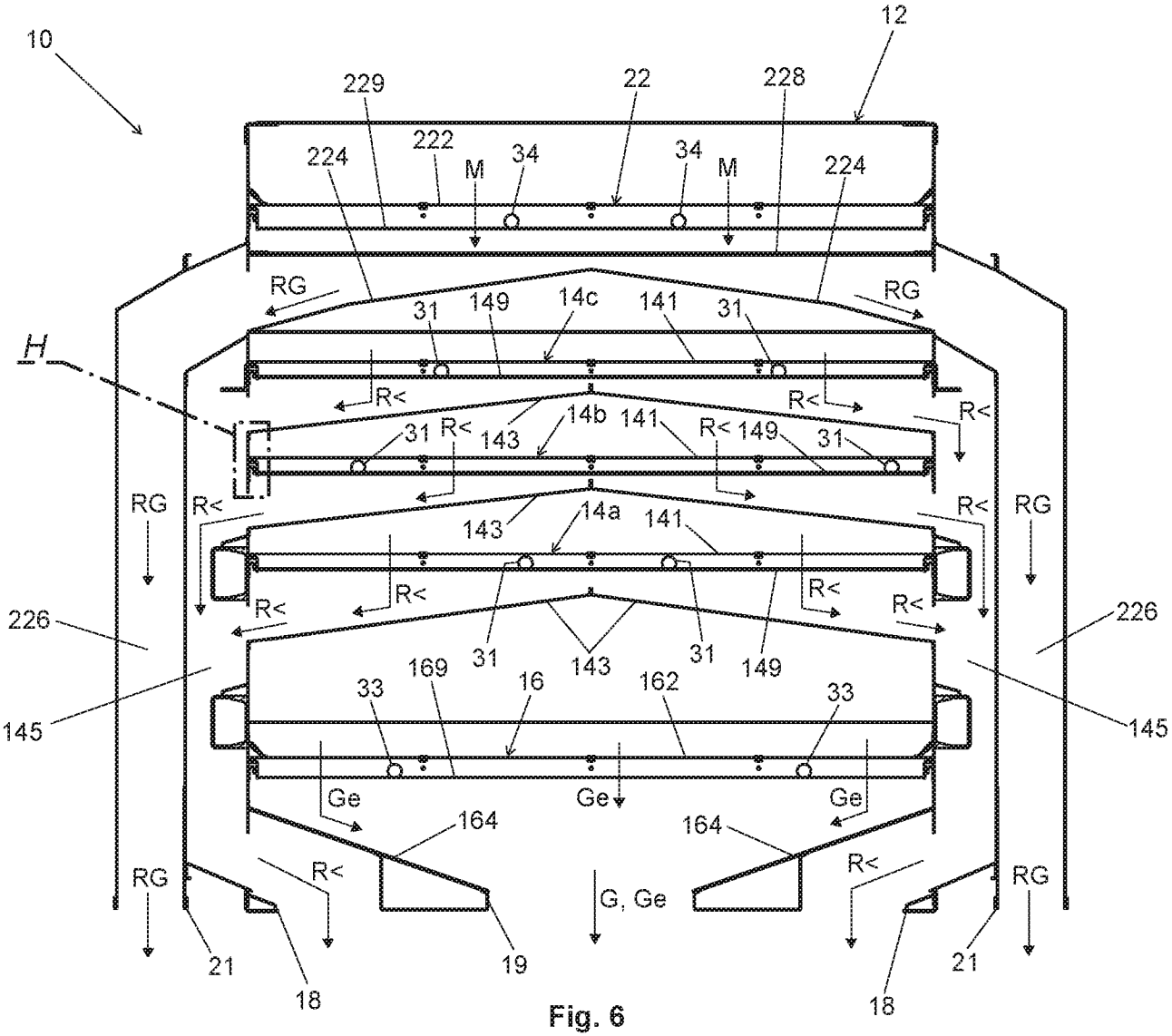
FIG. 6 shows a section cut according to secant plane "F-F" shown in FIG. 3. For better understanding, the position of secant plane "F-F" is also indicated in FIG. 4.

In the embodiment shown, as can be seen in FIGS. 4 to 6, the sieve arrangement further comprises an upper sieve level (22) comprising a coarse sieve (222). The upper sieve level (22) is positioned above the respective main sieve levels (14*a*, 14*b*, 14*c*), and inclined to the horizontal from a high side (L5) to a low side (L6), the low side (L6) of the upper sieve level (22) is in communication with at least one outlet of residues larger than grains (21). Below the coarse sieve (222) is disposed at least one mixture-carrying channel (228), preferably a pair of mixture-carrying channels (228), as shown in FIGS. 4 and 5, having a slope toward the high side (L1) of the respective main sieve levels (14*a*, 14*b*, 14*c*). The coarse sieve (222) has a mesh configured to prevent the crossing of coarse residues larger than grains (RG), such as pieces of wood, bricks, stones, among other objects of expressive size, which could become stuck at subsequent sieve levels (14*a*, 14*b*, 14*c*, 16).

A machine (10) configured with an upper sieve level (22), in operation, as can be seen from the schematic arrows shown in FIGS. 5 and 6, receives a mixture of grains and residues (M) through the inlet opening (13). The mixture (M) accesses the upper side (L5) of the upper sieve level (22), forming a mixture layer (M) on the coarse sieve (222). Due to the inclination of the upper sieve level (22) and due to the oscillating movement of the sieve arrangement produced by the vibration system, the mixture layer (M) moves toward the low side (L6) of the upper sieve level (22). As the mixture (M) advances, said mixture (M), with the exception of the coarse residues larger than the grains (RG), passes through the coarse sieve (222) and falls onto the mixture-carrying channel (228), then conveyed to the high side (L1) of each main sieve level (14*a*, 14*b*, 14*c*), then following the path described above. Note that the mixture (M) passing through the coarse sieve (222) includes the grains (G), the residues smaller than grains (R<) and the residues larger than grains (R>), the latter, however, smaller than the coarse residues larger than grains (RG). The coarse residues larger than grains (RG) follow over the coarse sieve (222) until they reach the lower side (L6) of the upper sieve level (22), and then are sent to the outlet of coarse residues larger than grains (21). According to the embodiment shown, as can be seen in FIGS. 4 to 6, the lower side (L6) of the upper sieve level (22) is in communication with a coarse-carrying channel (224), which is bifurcated in two paths along a downward slope from the center towards the front and back of the machine (10), each path being in communication with a respective outlet of coarse residues larger than grains (21), through a respective vertical conduit of coarse residues (226), as best shown in FIG. 6. The upper sieve (22), along with its respective carrying channels (224, 228), conduits (226), and outlets (21) are optional, in view of the fact that the mixture (M) may be free of course residues larger than the grains (RG), before entering the machine (10), for example because it has been pre-processed in another machine intended for this purpose.

Preferably, a lower curtain (167) is disposed over the lower sieve level (16), the lower curtain (167) having an upper end attached to a rod and a tail in contact with the lower grain sieve (162). The lower curtain (167) is positioned transversely so that a portion of the lower grain sieve (162) is located behind the lower curtain (167) toward the low side (L4). The lower curtain (167) acts as a barrier for surplus grains (Ge), including those with higher kinetic energy and/or bouncing grains, so that they are contained and accommodated over the lower grain sieve (162) so as to be able to pass through said lower grain sieve (162), rather than being unduly discarded through the outlet of residues larger than grains (20).

Preferably, upon the upper sieve level (22), when the machine (10) is configured therewith, there is disposed an upper curtain (227) having an upper end attached to a rod and a tail in contact with the course sieve (222). The upper curtain (227) is positioned transversely so that a portion of the coarse sieve (222) is located behind the upper curtain (227) toward the low side (L6). The upper curtain (227) acts as a barrier to the mixture of grains and residues (M), including grains (G) with higher kinetic energy and/or bouncing grains, so that they are contained and accommodated on the coarse sieve (222), so as to be able to pass through said coarse sieve (222) rather than being unduly discarded through the outlet of coarse residues larger than grains (21).

Preferably, between each fine sieve (141) and the respective fine-carrying channel (143) is disposed a respective fine ball retaining plate (149), which retains a plurality of fine balls (31). Preferably, between each grain sieve (142) and the respective grain-carrying channel (144) is disposed a respective grain ball retaining plate (148), which retains a plurality of grain balls (32). Preferably, between the lower grain sieve (162) and the respective lower grain-carrying channel (164) is disposed a respective lower grain ball retaining plate (169), which retains a plurality of lower grain balls (33). Preferably, when the machine (10) is configured with the upper sieve level (22), a respective coarse ball retaining plate (229) is disposed between the coarse sieve (222) and the respective mixture-carrying channel (228), which retains a plurality of coarse balls (34). Each plate (149, 148, 169, 229) has a mesh of holes, for example squares, of suitable dimensions to retain the corresponding balls (31, 32, 33, 34), and at the same time to allow traversal of material that has already passed through the corresponding sieve (141, 142, 162, 222). In operation, due to the oscillating movement of the sieve arrangement produced by the vibration system, the balls (31, 32, 33, 34) bounce and collide with the corresponding sieves (141, 142, 162, 222), preventing any residues (R<, R>, RG) or grains (G, Ge) to become stuck in certain holes of the mesh of the corresponding sieves (141, 142, 162, 222), which could unduly interrupt the flow of material through the sieves (141, 142, 162, 222).

Figure 7:
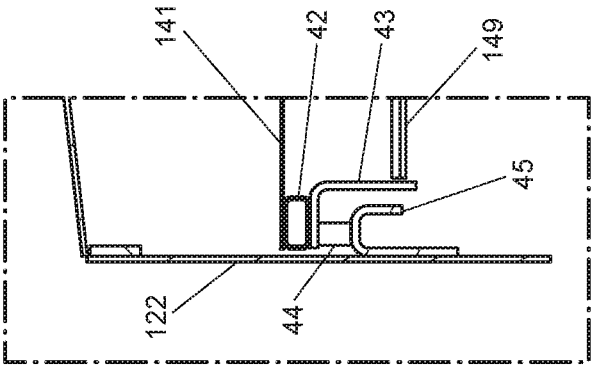
FIG. 7 shows an enlarged view according to the "H" region shown in FIG. 6.

For example, each sieve (141, 142, 162, 222) and the respective retaining plate (149, 148, 169, 229) may be manufactured so as to form an assembly, for example screwed and/or welded. Assemblies formed by sieves, retaining plates, and balls are known in the prior art. FIG. 7 shows an example of assembling the assembly and an example of attaching the assembly to the machine (10) used in a fine sieve (141) of the second main sieve level (14*b*). The other sieves (141, 142, 162, 222) of the other sieve levels (14*a*, 14*b*, 14*c*, 16, 22) may follow a similar assembling of the assembly and attaching the assembly in the machine (10). As can be seen in FIG. 7, the assembly is formed by the fine sieve (141) fixed to a corner bar (42), which is fixed on an "L" plate (43) connected to the fine ball retaining plate (149). Further, a shim (44), for example made of rubber, is attached below the "L" plate (43). In the machine (10), this assembly is supported on an inverted U-shaped longitudinal support (45), which is secured to a rear closure plate (122). Likewise, the assembly is also supported on a longitudinal support secured to a front closure plate. The assembly may also be engaged or secured in transverse supports.

For example, for a machine (10) configured for soybean cleaning, each fine sieve (141) may have a mesh having a plurality of holes with a diameter of 3 mm, each grain sieve (142) and each lower grain sieve (162) may have a mesh having a plurality of holes with a diameter of 9 mm, and each coarse sieve (222) may have a mesh having a plurality of oblong holes measuring 16 mm×35 mm.

The machine (10) comprises a vibration system configured to oscillate the sieve arrangement. Different vibration systems employed in a grain-cleaning machine that uses grain size separation by sieves are already known in the prior art. In particular, the vibration system used in the depicted embodiment is known in the prior art. As best shown in FIGS. 1, 4, 9, and 10, this vibration system comprises an electric motor (52) supported in a position external to the housing (12), in the front region of the machine (10). The electric motor (52) has a shaft coupled to a pulley (53). A flywheel (54) is internally secured to the housing (12), in a central position in the machine (10). The flywheel (54) supports a counterweight (55) positioned in a decentralized manner. A belt (56) connects the pulley (53) to the flywheel (54). In operation, the rotation of the electric motor (52) is transmitted to the unbalanced rotating flywheel (54). The machine (10) is integrally suspended in a gantry (not shown), by means of steel cables (not shown) engaged in four suspension points (57) distributed around the machine (10). As the machine (10) is suspended, the unbalanced rotation of the flywheel (54) produces an oscillation throughout the machine (10), and thus an oscillation in the sieve arrangement.

Naturally, the machine (10) of the invention could be configured with other known vibration systems. In case the machine (10) is configured asymmetrically, which would be equivalent to a half machine in relation to the embodiment shown, and when a vibration system equivalent to that described above is used, the flywheel (54) must be secured in a central position relative to the dimensions of the half machine.

The preferred or alternate embodiments described herein are not to be construed as limiting the present invention to structural forms, but there may be constructive variations which are equivalent without, however, departing from the scope of protection of the invention.

The invention claimed is:

1. A grain-cleaning machine for obtaining grains having a desired size which is greater than a lower value and less than or equal to an upper value, the grain-cleaning machine comprising a housing having an inlet opening, an arrangement of sieves disposed internally of the housing, a vibration system configured to oscillate the arrangement of sieves, the arrangement of sieves comprising at least two main sieve levels positioned overlapping each other and having an inclination to the horizontal from a high side to a low side, each main sieve level comprising a respective fine sieve followed by a respective grain sieve, wherein a respective fine-carrying channel is arranged below each fine sieve (141) in communication with at least one first residues outlet and below each grain sieve is disposed a respective grain carrying channel in communication with at least one grain outlet, at least one lower sieve level comprising a respective lower grain sieve, wherein a lower grain-carrying channel is arranged below the lower grain sieve in communication with at least one grain outlet, the at least one lower sieve level being positioned below the main sieve levels, and inclined to the horizontal from a high side to a low side, wherein the low side of each main sieve level is in communication with the high side of the at least one lower sieve level through a vertical passage and the low side of the lower sieve level is in communication with at least one second residues outlet, wherein each fine sieve has a first mesh provided with openings having an opening size which is equal to said lower value and wherein each grain sieve and each lower grain sieve have a second mesh provided with openings having an opening size which is equal to said upper value.

2. The machine according to claim 1 comprising a lower curtain on the lower sieve level, the lower curtain having an upper end fixed to a rod and a tail in contact with the lower grain sieve, said lower curtain being positioned transversely so that a portion of the lower grain sieve is located behind the lower curtain toward the low side of the lower sieve level.

* * * * *